US007208570B2

(12) United States Patent
Saviainen

(10) Patent No.: US 7,208,570 B2
(45) Date of Patent: Apr. 24, 2007

(54) METHOD OF REFINING TALL OIL

(75) Inventor: Juhani Saviainen, Rauma (FI)

(73) Assignee: Forchem Oy, Rauma (FI)

( * ) Notice: Subject to any disclaimer, the term of this patent is extended or adjusted under 35 U.S.C. 154(b) by 227 days.

(21) Appl. No.: 11/060,938

(22) Filed: Feb. 18, 2005

(65) Prior Publication Data

US 2005/0182240 A1 Aug. 18, 2005

(30) Foreign Application Priority Data

Feb. 18, 2004 (FI) ..... 20040260

(51) Int. Cl.
*B01D 3/42* (2006.01)
*C10G 7/00* (2006.01)

(52) U.S. Cl. ..... 530/205; 73/32; 73/861; 196/132; 196/141; 201/1; 203/1; 208/41

(58) Field of Classification Search ..... 530/205
See application file for complete search history.

(56) References Cited

U.S. PATENT DOCUMENTS

2003/0144548 A1 7/2003 Huckman et al.

FOREIGN PATENT DOCUMENTS

EP 0 149 831 7/1985

OTHER PUBLICATIONS

Gidroliz. Lesokhim. Prom., vol. 23, No. 2, PAPERCHEM2, Elsevier Engineering Information Inc., Copyright 2004 (Abstract).

"Coriolis Meters Used to Measure Density-Related Physical Properties," Annual ISA Analysis Division Symposium Proceedings 2000, vol. 33, pp. 159-168.

"Refining and Separation of Crude Tall-Oil Components," Separation Science and Technology, vol. 31, No. 17, 1996, pp. 2307-2316.

"Micro Motion Refinery Applications," A list of refinery applications with Micro Motion flowmeters, copyright Micro Motion, Inc., 2001, published by Emerson Process Management.

"Micro Motion Elite Mass Flow and Density Meters with MVD Technology," Micro Motion Product Data Sheet PS-00374, Rev. F, Jun. 2006, published by Emerson Process Management.

Naval Stores: Production, Chemistry, Utilization, (Duane F. Zinkel and James Russell, eds), New York, Pulp Chemicals Association, 1989, pp. 160-162.

*Primary Examiner*—James Seidleck
*Assistant Examiner*—Gennadiy Mesh
(74) *Attorney, Agent, or Firm*—Smith-Hill and Bedell

(57) ABSTRACT

The present invention relates to a method of refining crude tall oil. According to the method, the crude tall oil is fed into a column distiller, where it is separated into desired fractions. The conditions of the column distiller are adjusted on the basis of the composition of the feed and the product flow. According to the present invention, the densities of the crude tall oil fed into the column distiller and of at least one product flow are measured accurately as a function of the temperature. The density values are compared with correlation coefficients derived from the chemical compositions of the flows, coefficients which are obtained on the basis of laboratory analyses made earlier from corresponding flows, by using temperature compensation to specify the correlations, and by taking account of the regular variation in the wood composition of fresh wood according to the annual cycle and, as a result, the compositions of the flows are achieved. The present invention decreases the number of chemical analyses and improves the uniformity of the products.

12 Claims, No Drawings

METHOD OF REFINING TALL OIL

This application claims priority under 35 USC 119 of Finnish Patent Application No. 20040260 filed Feb. 18, 2004.

BACKGROUND OF THE INVENTION

The present invention relates to a method of refining tall oil.

In a method such as this, the crude tall oil is fed into a column distiller in which it is separated into desired fractions, at least part of which are recovered as product flows.

Fibers, lignin and other wood components, such as fatty acid fractions and resin acid fractions as well as neutral extractives, are released associated with the process of pulping. After washing, the cellulose is mainly used for papermaking and the lignin fraction is generally burned, whereas the cooking chemicals are recovered and regenerated. The residual liquor of the sulfate cooking (black lye) is vaporized before the burning, and the extractives and the tall oil soap are recovered from the surface of the partly concentrated residual liquor, following the fourth vaporization stage. The recovered tall-oil soap is acidified and, as a result, the fatty acids and the resin acids are released and with them the neutral extractives are carried forward in the process.

The acid, the water and the lignin as well as the accompanying fiber residues are returned to the regeneration processes of the pulping and the crude tall oil is processed by distillation at a low pressure.

Different solutions have been developed for regulating the distilling processes in the processing industry. In the literature, a general control method for column distillers is known in which the bottom efficiency or the bottom number of the entire column, both of which depend on the gas flow and the reflux ratio, is taken into account in the calculations. By adjusting these, the distillation can be controlled, for instance when the feed is changed.

In improved methods, the distillation is controlled by simulation and by analyzing the product and feeding flows of the distillation. Thus, U.S. Pat. No. 6,088,630 describes a means to control the distillation, a means that is based on the idea that the process is simultaneously measured and simulated, and the parameters that are obtained as a result of these functions are changed so that the parameters used in the simulation are average temperatures of the columns. It is proposed that the method can be employed in cases where the measuring of the average temperatures of the columns replaces expensive and time-consuming gas chromatography analyses and/or mass spectrometry analyses. According to the example in the patent publication, the average temperatures from nine different bottoms are measured in the distillation of toluene and xylene, and based on these measurement results the concentration profiles are calculated and the reboiling and the reflux ratio are adjusted so that the desired calculated concentrations are achieved.

It is obvious that a method like this is only suitable in cases with a substantial difference between the boiling points of the products to be distilled.

Another patent, U.S. Pat. No. 5,343,407, describes a non-linear model for controlling the distillation. In this model, the distillate, the bottoms product and the feed are analyzed and on the basis of the analysis results the bottom efficiencies of the distillation at the moment of the analysis are recalculated, assuming that the vaporabilities of the components are known and they are constant. From these parameters the bottom boiler capacity and the distillation reflux ratio are recalculated and reoptimized.

According to the examples of the patent publication, the purpose of the solution described above is mainly to prepare monomers that are very pure and can be analyzed quickly, for instance by means of gas chromatography (due to the low molecular weight of the compounds).

The situation whereby tall oil is distilled is quite different from the distilling of small molecular hydrocarbons. The problems are associated with, among others, to the analyzing of product flows and to real time collecting of desired information about those flows. The bulk of tall oil components are resin and fatty acids, whereas a smaller percentage consists of neutral extractives. Analyzing of the components, which are in acid form, by means of gas chromatography generally requires silylation or methylation of the compounds, which makes it difficult to analyze those components directly during the process. In such cases, the columns of the gas chromatography equipment generally endure only a few weeks of continuous use.

A direct "on-line" analysis is significantly more successful when a mass spectrometer is used. However, mass spectrometers are expensive and demand continuous expensive service.

As a result, it is difficult to obtain the measurements that are needed in known controlling methods for distillation of tall oil and corresponding natural products.

The purpose of the present invention is to eliminate the disadvantages associated with known technology, and to generate an entirely novel solution for the controlling of distillation of crude tall oil and thus for producing tall oil products.

In this method, the crude tall oil is fed conventionally into a fractionating column distiller, in which it is separated into the desired fractions, at least part of which are recovered as a product flow. The conditions of the column distiller are in this way regulated on the basis of the composition of the feed and the product flow.

The invention is based on the idea that instead of the flows being analyzed in the laboratory, in order for the compositions to be continuously determined, the density of the flows in process is measured in real time using a high measurement and reading accuracy.

SUMMARY OF THE INVENTION

In general terms the present invention comprises the following features

- measuring the density of the crude tall oil, which is fed into the column distiller, and of at least one product flow,
- the density is measured to an accuracy of at least 5 significant figures, or, correspondingly, 4 decimal places as a function of the temperature,
- the composition of each flow is calculated from the density, and
- the conditions of the column distiller are regulated on the basis of the composition of the feed and the product flow.

In order to calculate the composition on the basis of the density value, the exact temperature of the flow is also measured at the same time as the density is measured. This is important because in each flow the density is a function of the temperature and this dependence varies in different flow compositions. From the density values it is therefore possible to derive the corresponding chemical compositions of the flows by using correlation functions, which have been obtained on the basis of laboratory analyses and by using temperature compensation for specifying the correlations, as mentioned above.

The correlations can be specified preferably by taking into account the normal variation in the wood composition (so called day function) of fresh wood, according to the annual cycle. This relates especially to the quality and the pitch forecast of the crude tall oil.

Thus, the compositions of typical tall oil distillery products can be determined by using the density and the temperature corresponding to that density, provided that the density can be measured with adequate accuracy, whereby the different product flows and the variations of their compositions are distinguishable in the density measurements. This distinguishability can be improved further by using the day function described in the present invention.

The present invention can also generate a new method of application for such devices, the purpose of which is to measure, inter alia, the density of liquid flows (or other devices which are otherwise suitable for that purpose), and which can determine reproducibly the density of the liquid flow of tall oil or its fraction with a high degree of accuracy, most suitably at least an accuracy of 4 decimal places or, correspondingly, 5 significant figures.

Considerable advantages can be achieved with the present invention. Thus, the invention generates a method of controlling a tall oil distillery, which method substantially decreases the need for chemical analyses and, at the same time, improves the uniform quality of the products. In practice, an increased distillation capacity and a better yield can be achieved with the invention.

Parameters central to the distillation are the concentrations of the resin acids and the unsaponified shares in the feed, as well as the acid number of the distillate. If it is possible to calculate these from the density figures, using regression equations (in the following also "correlation functions"), the regulators for draw-off of each distillation can steer the properties of the product directly to their set values, as long as the regulators are first taught how to regulate the outlets of the process to their set values with the help of fuzzy logic and neural network calculation, methods which are known per se.

It was surprising that the correlations, which enabled the controlling of the process and the prediction of the pitch forecast and the cloud point/stearic acid forecast in fatty acids already from the raw material, were discovered only when the density was measured to at least 5 significant figures, and the correlations were significantly improved further when the day function was taken into account.

The conditions of the column distiller or distillers are adjusted on the basis of the preceding information so that the desired property of the product is achieved, and that the measurements made at the beginning of the process are taken into account in advance bearing in mind the later column distillers and their adjustments.

DETAILED DESCRIPTION

In the following, other details and benefits of the present invention are described with the help of a detailed explanation.

As mentioned before, the present invention generates a method of refining the crude tall oil, which has been recovered from the pulping of pine wood, the harvest time of which is known, especially of controlling the distillation of crude tall oil. According to the method we have developed, the process is not controlled by simulating the distillation and by replacing the overall degree of extraction as well as by fixing the parameters again and again, as described in U.S. Pat. No. 6,088,630. Instead, in our method the density of the flows generated from the distillation and, correspondingly, fed into the distillation, are measured very carefully as a function of the temperature. The latter means that the temperature must be simultaneously measured very accurately, because the density is a function of the temperature. The reason is that associated with the present invention we have unexpectedly discovered that when the density of the important flows of the distillation is determined, still the fourth, or even the fifth or the sixth decimal place is significant when the corresponding chemical composition, which is used to control the distillation, is concluded on the basis of the density. In that case, the density unit is $kg/dm^3$. If SI units are used ($kg/m^3$) the density is correspondingly measured to an accuracy of 5 significant figures.

The temperature is measured to an accuracy of at least 3 significant figures, most suitably of at least 4 significant figures.

In this case, "important" flows are particularly the feed flow of crude tall oil and the tall oil distillate/distillates.

After the correlation calculations it was discovered that the properties of the different products were revealed by using the temperature function of the density, which density function, surprisingly, was clearly different in the products coming into the distillery compared to the intermediate products and the end products of the distillery. In this way, it is possible to accurately characterize or "analyze" the properties of different products. The day function, i.e. the cutting time of the wood, affects the resin and the fatty acid composition of the wood, and thus helps to generate a second dimension for the density/temperature dependence.

According to the present invention, the density of the crude tall oil which is fed into the column distiller, and the density of at least one product flow (especially distillate) is thus measured. From the density value thereby obtained the flow composition is calculated by using correlation functions derived from the chemical compositions of the flows, functions that are obtained on the basis of laboratory analyses made earlier from corresponding flows. To take account of the temperature dependence of the density, a term signifying temperature compensation is added in these correlation functions.

Thus, according to one application of the invention the density of the crude tall oil fed into the column distiller and also at least one product or intermediate product is continuously measured as a function of the temperature, whereby the density is measured to an accuracy of at least 5 significant figures and the temperature corresponding to the density to an accuracy of at least 3 significant figures. Because a density measured with this accuracy correlates with the composition of the material flow, it is not necessary to analyze or determine the chemical composition. Instead, the distillation can be controlled on the basis of the information regarding the density of the material flows.

When designing our method, the tall oil products being relatively macromolecular compounds, the composition of which varies according to the time of year the trees were harvested, and even according to the pulp mill and the geographical area whence the trees came, has been taken into account. As stated above, controlling and analyzing methods that are familiar for instance in petrochemistry are useless in refining of tall oil. Also, calculation methods used in multicomponent distillation, in which the controlling quantities needed for controlling the distillation are calculated according to the bottom-to-bottom principle, are not appropriate for direct controlling of the process.

To take into account the regular variations in fresh wood caused by the annual cycle, a so called day function has been added, which can be for instance the absolute value of e.g. a sin(x) function (see Formula I), or a $\sin(x^2)$ or a normal distribution function or a gamma-function.

The simplest format of the day function can be A×|(date−182)/365]| or A×|sin [(date−182)/365]| (A is a numerical value). The former formula describes the linearly increasing and decreasing value, and the sine expression describes the uniformly increasing and decreasing value. The day number=the calendar day 1→365−90→115, which forward movement in time describes the delay from the stump via the recovery of the crude tall oil to the first distillation of the refining of the tall oil. Both of these correlations have generated results that are good enough, as well as a substantial improvement in the correlation coefficients and the standard deviation.

Consequently, when the standard error for instance in the resin acid percentage in crude tall oil was 0.77 units applying the linear day function, and 0.65 units applying the sinusoidal day function, it was 2.7 units without the day function.

According to one of the applications the day function has the following format:

$$A\times|\sin[(\text{day number}-182)/365]|+B \qquad \text{I}$$

whereby

A represents a correlation coefficient, which is determined empirically on the basis of the results of the analysis of the composition B represents a correlation constant, which also is determined empirically on the basis of the results of the analysis of the composition, and the "day number" is the respective day of the year, i.e. an integer between 1 and 365

A and B are numerical values.

The coefficient A is obtained from the regression correlations that are calculated on the basis of previously made laboratory analyses at each plant, and the constant B depends on the geographical latitude of the source zone of the wood.

"The day number" represents the harvest day of the wood, but the day on which the measurements were taken can still in practice be used instead, provided that the period between the harvest time and the processing time (pulping) of the wood is typically of a constant length, or essentially of a constant length (maximum range +/−20%).

Thus, in the present invention, "the pine wood with a known harvest time" means either wood, the harvest time of which is known, or wood having a fixed time period between its harvest day and its processing day that remains essentially constant over a long time (several weeks, months or even years, i.e. generally between 1 and 104 weeks).

For other functions, too, such as the $\sin(x^2)$ function, the normal distribution function or the gamma-function, it is equally simple to determine the corresponding parameters, which describe the seasonal variations.

When such a function is used as part of the correlation by which the regression curves are combined with the laboratory analyses of the compositions of the flows, the regression will already have a high level of accuracy (>90%).

The correlation coefficients of long-term measurements show the connection between the 5 significant figures (4 decimals) and the correlation coefficient. The correlation of crude tall oil was 81.7 and the standard error 0.77 units, of the pitch forecast 90.8% and the standard error 1.09, and the correlation of the softening point of tall resin was 93.7% and the standard error 1.1° C., when the specification accuracy of the laboratory was +/−1.0° C.

Application of the invention is made easier by the fact that the formation of pitch in the timber, i.e. the oxidation and esterification of fatty acids, has become controlled, while for instance in Finland the transportation of wood to the pulping has changed so that nowadays the time between the felling of the wood and the pulping of the cellulose mass is only approximately 2 weeks.

Nowadays, in Finland, trees felled in the winter are cold-stored under snow in large lots that remain covered with snow as late as in August. As a result, variations in quality are minimal because the temperature is kept at 0° C. and the storage is sealed from the surrounding air.

Previously, wood was stored for up to 2–4 months in the form of wood chips to avoid so called "resin problems". Today, this has been seen as both wrong and uneconomical. The new way of taking the wood directly from the forest to the pulping mill has both improved the quality of the tall oil products generated from wood and smoothed out variations in it, and made the quality more predictable, which predictability is utilized in the present invention, together with new measuring devices and accurate digital data transmission.

Consequently, one of the best applications of the method is the refining of such crude tall oil that has been recovered from the pulping of pine wood with a known harvest date.

With the help of the correlation functions it is possible, on the basis of the density and the day number, to calculate the compositions of the flows and, based on these, the conditions of the column distiller are adjusted. In other words: When the dependency of each distillate, bottoms product flow and feed density on the temperature, and the dependency of the composition on the density and the day function, are known from laboratory analyses, it becomes possible, using the correlation functions, to calculate the composition directly with the help of the density, the temperature and the day function.

Furthermore, when a digital signal is used in the process control instead of a conventional 4-20 mA signal, the digital signal suffers no interference from occasional starting of motors or from other magnetic disturbances.

As stated above, according to the present invention, the densities are measured as temperature compensated, at least from the crude tall oil feed and the product flows. Most suitably, the densities and the exact temperatures are measured, not only from the feed, but also from the bottoms product of the resin column, the distillate of the primary oil column, the bottoms product of the fatty acid column, and the distillate of the same column, as well as from the distillate of the resin column. With the help of these measurements it is possible, especially or if needed when the above-mentioned day function is taken into account, to calculate the accurate correlations for the following quantities:

Quantity of fatty acid in crude tall oil
Quantity of resin acid in crude tall oil
Share of unsaponified crude tall oil
Pitch forecast coming from the distillation +pitch composition
Concentration of resin acid in crude fatty acid
Acid number of resin
Quantity of the unsaponified
Softening point of resin
Acid number of fatty acid Concentration of resin acid in fatty acid
Acid number of bottoms products All these are calculated using regression models which are known per se, which are formulated on the basis of laboratory analyses and in which the above-described day number function corresponding to the time of the pulping is applied, in which day number the storage time of the crude tall oil is also observed (see Formula I above).

When the correlations are obtained, only a fraction of the previously run number of analyses are needed, and the quality of the products can, even more accurately than before, be kept constant or at a desired level.

It is assumed that the technology of each plant is always designed according to the state of the art and is possibly dimensioned in different ways and, as a result, the correlations obtained and the way they are applied will vary numerically from plant to plant. However, the methods are reproducible from one plant to another, assuming that the accurate measurements of the density, temperature and flow are functional and that the transmission of data is not distorted.

Preferably, the density can be measured with a Micro-Motion mass flow measuring device, made by company Fisher-Rosemount, which at its best gives a density accuracy of 0.5 kg/m$^3$ and a reproducibility of 0.2 kg/m$^3$ at a rated flow. At its best, the density/temperature accuracy is 0.03 kg/m$^3$/° C., which means that the device gives the measurement results to an accuracy of 5 decimal places. Thus, this device is excellently suitable for the density measurements in the present invention.

Furthermore, to create a system like this, it is desirable that the laboratory analytical methods that are used to calculate the correlations are accurate and reproducible. When the measurements, which, with the help of the densities, will provide the correlations, have been carried out in a laboratory, this will be strictly correct only if the zone of the supply of the wood is constant. Thus, an infrared analyzer, especially a NIR (near infra-red) analyzer, can more preferably be used to support the system. The problem described above can be removed by using a NIR analyzer when the composition of the crude tall oil is continuously analyzed with this analyzer. This means that the correlations can be calculated as continuously changing and specified, even when the zone of supply of the wood used in the production of crude tall oil is changed. Thus, specifically and preferably the composition of the crude tall oil is analyzed when it is fed into the distillation process. Typically, such a preferable device is a FT-NIR device, delivered, for instance, by Bruker Optics. This kind of a device makes it possible to determine the composition of the crude tall oil in a few seconds, with exactly the same accuracy as with conventional laboratory methods, that is, to an accuracy of approximately 0.2%.

With the help of the tall pitch fraction forecast it is possible to estimate the resin acid composition, which, in turn, correlates with the sterols, when the thermal history of the tall oil is known. With the help of these it is possible to estimate the quantity of alkali needed to saponify the resin acids, after which the unsaponified components can be distilled away.

However, it is also possible to separate the saponified fraction with the help of extraction and fractionation by using solvents. In this case, it is also possible to control the separation processes on the basis of the degree of saponification.

According to the distillation method we have used, the pressures of the column distillers are kept constant, i.e. essentially unchanged. Correspondingly, the surfaces of the bottom boilers of the columns are kept constant. Thus, parameters that change/can be changed are, above all, the temperatures of the distillation, i.e. the heating effect fed into the distillation, and the reflux ratio, i.e. the ratio between the flow removed from and the flow returned into the column distiller. These parameters are changed according to the density and the composition calculated on the basis of the density (especially according to the composition corrected using the day number function). The thermal stress on the bottom boiler, i.e. the amount of the heating energy fed into the boiler, is adjusted in order to correct the reflux ratio correspondingly, i.e. the thermal stress on the boiler is adjusted as a function of the reflux ratio. Conventional calculation models of the distillation technology are used for the operations listed above.

In practice, the method is carried out as follows:

1. The system is used to check every lot of crude tall oil that is received at the plant, as well as during the loading of every lot sent to the customers.

We are not aware of any comparable methods but we know that at some plant gas chromatographic analyses of the oil are taken from the storage tanks, which is too late for the controlling of the process. It might be considered that another distinguishing characteristic of this method is that only values of more than 4 or even 5 decimals (or 5 or even 6 significant figures) in the density measurements give sufficiently good correlations, which in combination with the annual cycle function, can be used as quantities that control the process and in forecasting.

2. On the basis of the daily analyses of the crude tall oil, a regression equation is developed in which the quantities of the resin acids, the acid number, and the unsaponified share are determined with the help of the density, the temperature and the day function, typically (Formula II and III).

$$\text{Resin acid, \%} = A1 + B1 \times \rho 1 + C1 \times T1 + D1 \times |\sin[(\text{day number} - 182)/365]| + B3 \quad \text{II}$$

$$\text{Acid number} = A2 + B2 \times \rho 2 + C2 \times T2 + D2 \times |\sin[(\text{day number} - 182)/365]| + B4 \quad \text{III}$$

wherein

A1, B1, C1, D1 and A2, B2, C2 and D2 represent correlation coefficients which are empirically determined on the basis of the analysis results of the composition, ρ1 and ρ2 are the liquid flow densities, T1 and T2 are the liquid flow temperatures, and B3 and B4 are the correlation constants.

3. With the help of these correlations the controlling quantities of the process are determined in the normal way, and these quantities are used to control the distillate draw-offs and, with the help of these draw-offs in the typical way, control the bottom boiler and the reflux ratio. In particular, the proceedings are then that the pressure in the column of the distillation as well as the quantity of the liquid at the bottom boiler are kept constant, and the amount of energy fed into the boiler as well as the reflux ratio of the distillate are varied.

4. The corresponding regression equations are also developed for the resin columns, the primary oil columns and the fatty acid columns. These regressions are linked together and the result is an analysis system, which controls the entire process and in which laboratory measurements are only infrequently needed.

5. The process is controlled with the help of the analysis system when it is known which quality each bottoms product and each distillate represents at that moment. Experience demonstrates and general theories of distillation show that it is possible to control the process in such a way that the desired product is generated, and that it is possible to move rapidly from one quality to another, within the limits for which each distillation process is designed.

The phrases "in the normal way" and "experience demonstrates" above mean that, for instance, the variables of the distillation, the temperature of the bottom boiler, i.e. the heat flux, the composition and quantity of the feed, the reflux ratio etc. are connected to describe each other, for instance with correlations given by neural network calculation, which means that the correlations are connected to describe the process with real variable quantities of the process, in ways familiar to the professionals in the field.

In the neural network method, the coefficients and the powers of the variable quantities, as well as the interactions are calculated. Another way of doing this is to directly use, in a known way, a distillation process model, which is known per se. We have been successfully doing this, even by merely using logarithmic correlation equations, which are available in spreadsheet programs, and which were used to create what are called the "process equations" of the system. These can be obtained for instance from the resin acid and the acid number equations described above. With the help of these, the product outlets of the process are regulated so that the quality remains constant, and the regulation is effected by, for example, changing the reflux ratio.

EXAMPLE

An example of how the method can be applied is as follows:

At a tall oil plant, the feed of crude tall oil, and the distillate of the fatty acid column were analyzed by means of gas chromatography in order to determine the carbohydrate components included in them, for instance the resin acids and the unsaponified part, as well as the acid number. At the same time, the flow densities were measured. On the basis of the analysis results and the density values the regression curves were calculated and the coefficients were determined by applying Formula II and III above.

Feed of crude tall oil, resulting in equations:

Resin acids, HH, %=−295.2746+331.7601×ρ1+0.2422×(*T*1/° C.)+{284×|sin [(day number−182)/365]|−2.47}

Unsaponifieds in crude tall oil, %=−4.8618+13.8259×ρ1−0.00122×(*T*1/° C.)+{−568.9×|sin [(day number−182)/365]|+0.4894}

Distillate from fatty acid column:

Acid number, HL,=436.8175−259.8231×ρ2−0.1942×(*T*2/° C.)+{1328×|sin [(day number−182)/365]|+0.4894}

T1=temperature of crude tall oil, ° C.

T2=temperature of distillate, ° C.

ρ1=crude tall oil density, kg/m$^3$

ρ2=distillate density, kg/m$^3$

Finally, an additional advantage of the present invention is that with the help of the process control method we have been able to improve also the separation of the fatty acids from the tall oil pitch, so that a possible separation of the unsaponifieds in the further refining is facilitated, if the pitch is almost free from fatty acid. The share that is unsaponified varies significantly according to the day function, i.e. the share of sterols varies according to the time of year and in Finland is at its biggest around the end of July and into early August. Because the quantity of the neutral material, i.e. the sterols, which are of commercial interest, varies significantly according to the season, it is possible, based on the pitch forecast obtained by the method, to calculate very accurately the forecast of the neutral material in the pitch. Based on this forecast, for the further refining it is possible to dose the correct amount of alkalis with water into the pitch in order to saponify resin acids in the pitch, to predict the time needed to separate the sterol esters and, also to predict the yield of the sterols in the subsequent separation of neutral material. Using methods that are known per se, this oil can be either vacuum distilled or steam distilled, or extracted with solvents in order to separate and/or fractionate the sterols.

As a result of implementing this method, the capacity of the distillation is increased, the quality fluctuations are minimized and the yields are improved Examples of the other correlations are as follows:

Stearic acid concentration, %=*B*3−*d*×(crude tall oil/resin acid, %)−*e*×(primary oil density, kg/m3)

Cloud point of fatty acids, ° C.=*D*+*f*×(stearic acid concentration, %)

B3=6.6167, d=0.1417, e=0.0120, D=17.71 and f=11.7322

The other above-mentioned quantities can be calculated in a corresponding way by deriving the correlation coefficients for the density values from the analysis results.

Under comparison are the crude tall oil forecasts from several different dates and the corresponding pitch forecasts, both of which have been used to formulate a correlation equation from the data gathered during approximately one year, and the correlation coefficient representing the whole period.

Day function (e.g. A×|(date−182)/365]| or A×|sin [(date−182)/365]| (A is a numerical value) is directed for example only at the crude tall oil correlation, which is Resin acid %=b1+m1×density+m2×temperature+m3×date function, having 81.7% regression with the correlations b1−391.2633 m1=430.5321 m2=0.2325 m3=4.1608

The m3 coefficient is correlated with the day function |(date−90−182)/365]| in this case.

The correlation represents measurements of 133 days during the whole year—90 represents a 90 day delay, which is the average number of days from the cutting of the tree until the crude tall oil prepared from it has arrived at the factory and has been measured. In certain instances the number of delay days is up to 115 days.

Pitch forecast: Pitch %=b2+m4×density+m5×temperature+m6×day function, where the delay is 115 days. Here, too, the date function with these coefficients had the following format

|(date−115−182)/365]|

With the correlation of the regression coefficient being 90.8%, the coefficients based on 1 year's measurements are:

b2=99.2587 m4=−74.0603 m5=−0.0448 m6=−12.4329

Altogether, 140 measurements were carried out.

The regression table of the softening point (Pp) of tall resin represents 172 measurements. The correlation of the regression coefficient is 93.7%.

$$Pp/^\circ\ \text{C.}=b3+m7\times\text{temperature}+m8\times\text{density}$$

m7=1091.5885 m8=0.8408

Pp is usually approximately 50–67° C., the deviation being +/−1.1° C.

The invention claimed is:

1. A method of refining the crude tall oil recovered from the pulping of pine wood with a known harvest time, according to which method the crude tall oil is fed into a column distiller, wherein it is separated into desired fractions, at least a part of which are recovered as a product flow, wherein the density of the crude tall oil fed into the column distiller and of at least one product flow is measured, the density is measured to an accuracy of at least 4 decimal places or, correspondingly, 5 significant figures as a function of the temperature, the compositions of the flows are calculated from the density values by using correlation functions derived from the chemical compositions of the flows, which correlation functions are obtained on the basis of previously performed laboratory analyses of corresponding flows using temperature compensation to specify the correlations, and taking into account the regular annual cycle variation in the wood composition of fresh wood, and the conditions of the column distiller are adjusted on the basis of the composition of the feed and the product flow.

2. A method according to claim 1, wherein the correlation coefficient between the density and at least one of the following quantities is determined, as a function of the temperature:

Quantity of fatty acid in crude tall oil

Quantity of resin acid in crude tall oil

Share of unsaponified crude tall oil

Pitch forecast coming from the distillation and pitch composition

Concentration of resin acid in crude fatty acid

Acid number of resin

Quantity of unsaponified

Softening point of resin

Acid number of fatty acid

Concentration of resin acid in fatty acid

Acid number of bottoms products.

3. A method according to claim 1, wherein the function which takes into account the annual cycle variation of fresh wood is complemented by a function for the storage temperature of the wood:

$$A\times|\sin[(\text{day number}-182)/365]|+B$$

whereby

A represents a correlation coefficient which is determined empirically on the basis of the results of the analysis of the composition, B represents a correlation constant which also is determined empirically on the basis of the results of the analysis of the composition, and "day number" is the respective day of the year, i.e. an integer between 1 and 365.

4. A method according to claim 1, wherein the density is taken into account, as a function of the temperature, at an accuracy of 5 decimal places in the density measurements of the product flows.

5. A method according to claim 1, wherein the distillation is controlled by creating a control signal on the basis of the measured density value and the corresponding correlation coefficient, which control signal is used to adjust the quantities which have an effect on the column distiller.

6. A method according to claim 5, wherein a digital signal is used to control the distillation.

7. A method according to claim 1, wherein, in order to adjust the column distiller, the pressure of the column and the surface of the bottom boiler of the column are kept essentially unchanged, and the temperature of the distillation and the reflux ratio of the distillate are adjusted on the basis of the densities of the feed and the product flow.

8. A method according to claim 7, wherein the amount of energy fed into the bottom boiler of the column distiller, i.e. the thermal stress on the bottom boiler, is adjusted as a function of the reflux ratio.

9. A method according to claim 1, wherein the amount of neutral material and thus the amount of sterols is determined with the help of the forecast of the tall oil pitch fraction and the resin acid.

10. A method according to claim 9, wherein, on the basis of the amount of sterols, the quantity of alkali needed for a predefined degree of saponification for the further processing of pitch is dosed, whereby the further distillation of the saponification is controlled by the thermal stress corresponding to the predefined degree of saponification.

11. A method according to claim 9, wherein, on the basis of the amount of sterols, the quantity of alkali needed for a predefined degree of saponification for the further processing of pitch is dosed, whereby an amount of solvents corresponding to the predefined degree of saponification is directed to the extractive separation and the fractionating.

12. A method according to claim 1, wherein the feeding flow of the crude tall oil is analyzed with a continuous Fourier-Transformation infra-red analyzer and the correlations are calculated according to the change in the raw material over and over again, whereby a dynamic distillation control of the second degree is achieved.

* * * * *